United States Patent [19]

Lohrer

[11] 3,942,690

[45] Mar. 9, 1976

[54] SLIDING GATE WITH SPRING BIASED BOLTS FOR SEALING

[75] Inventor: Leo Lohrer, Duren-Gurzenich, Germany

[73] Assignee: United States Steel Corporation, Pittsburgh, Pa.

[22] Filed: Oct. 16, 1974

[21] Appl. No.: 515,382

[30] Foreign Application Priority Data

Oct. 17, 1973 Germany ..... 7337290[U]

[52] U.S. Cl. ..... 222/512; 222/561

[51] Int. Cl.[2] ..... B22D 37/00; B22D 41/10

[58] Field of Search ..... 222/504, 512, 561; 251/144; 164/281, 335, 336; 85/1 SS; 266/42

[56] References Cited

UNITED STATES PATENTS 2,574,677 11/1951 Wieland ..... 85/1 SS

FOREIGN PATENTS OR APPLICATIONS 71,825 2/1893 Germany ..... 266/42

1,395,295 3/1965 France ..... 85/1 SS

*Primary Examiner*—Robert B. Reeves

*Assistant Examiner*—David A. Scherbel

*Attorney, Agent, or Firm*—Walter P. Wood

[57] ABSTRACT

Disclosed is a slidable gate for controlling flow of liquid metal from a bottom pour vessel. The gate is springpressed against a top plate. The springs engage bolts, the heads of which have a large number of small projections contacting the underside of the gate, whereby less heat is transmitted from the gate to the bolts and springs, and their useful life is prolonged.

6 Claims, 1 Drawing Figure

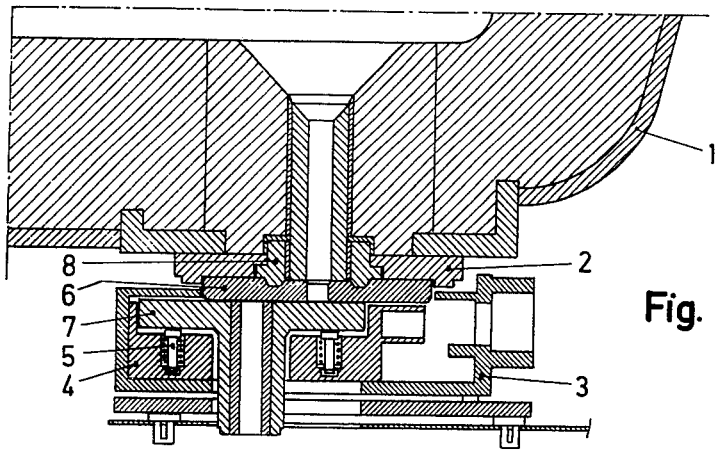
Fig. 1
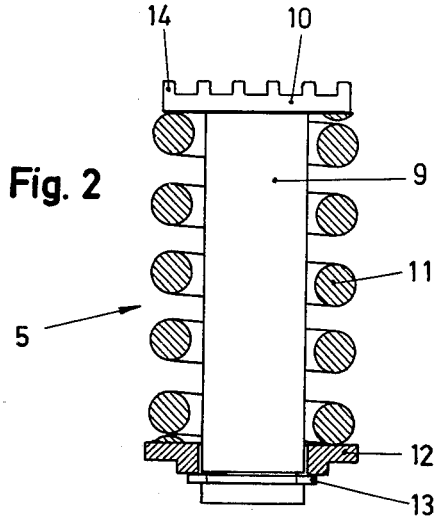
Fig. 2
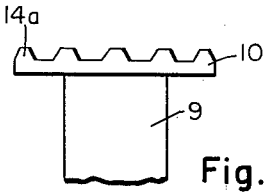
Fig. 4
Fig. 3
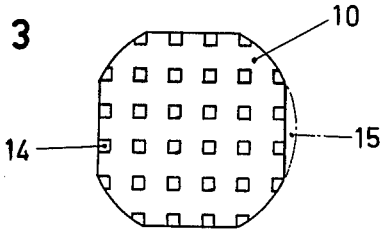

SLIDING GATE WITH SPRING BIASED BOLTS FOR SEALING

This invention concerns a slider valve for ladles for liquid metals, especially steel. A well established type of slider valve comprises a fixed, ceramic, replaceable head plate, mounted in a steel frame and a replaceable, ceramic sliding plate, mounted in a sliding frame, which grips, from underneath, the head plate, which can be shifted with respect to the latter, which is, by preference, power operated, which is pressed against the head plate by spring loaded bolts. The latter comprise a reinforced head, a compression spring acts upon the inner surface of the head and the upper surface of the head applies pressure to the bottom surface of the sliding plate.

Slider valves of this type have a sufficiently long life. The orifices in the head plate and in the sliding plate are formed by ceramic parts and therefore consist of mechanically strong and thermally resistant material. The head and the sliding plate can be easily replaced in case of damage or when the wear limit is reached.

Experience showed that an important factor in the increase of life of the head and of the slider plate was the thrust exerted by the sliding plate upon the outer surface of the head plate by spring elements. The latter provide the high thrust which is required, especially when the ladle is full, to ensure tightness under the effect of the hydrostatic pressure which appears at the slider. On the other hand the spring elements make it possible to avoid excessive thrusts during operation when the outer surfaces of the head and of the sliding plates are not perfectly smooth.

Experience has proved the effectiveness of compact spring elements for the generation of high thrusts with sufficient elasticity, within a limited space, in which a helical compression spring acts, from underneath, upon the reinforced head of a bolt and in which the top surface of the head takes hold, supports and puts under pressure the sliding plate. With this type of spring elements one can obtain the desired, favorable pressure characteristics and, with limited displacement of the bolts, replacement of the sliding plate is simple to perform. But experience has shown that the pressure spring characteristics, which are satisfactory at the beginning, will change in service and, after a prolonged time in operation, the thrust exerted upon the sliding plate will decrease.

The object of the invention is to improve the above described design of the slider valve to the point that the characteristics of the springs, which act upon the sliding plate, will remain constant after prolonged times in operation.

This object is accomplished by providing the top surfaces of the bolts, which transmit the thrust, with a certain number of projections the crests of which are located in the same plane transversely of the vessel.

Experience has shown that surface stresses which occur under load can be limited by providing projections on the head surfaces located in the plane transversely of the vessel. The projections can be square shaped or can have the shape of truncated pyramids. It was recognized to be an advantage to make the free spacing between projections larger than the dimension of the base of the projections so that each bolt which supports the sliding plate comprises a large number of top surface elements the sum of the surfaces of which is considerably smaller than the cross section of the head of the bolt.

The making of the projections is considerably simplified when they form an array consisting of rows separated by grooves. An additional simplification is obtained if a rectangular contour is superimposed upon the circular contour of the head.

The novel characteristics are described individually by using an example shown on the accompanying drawings wherein.

FIG. 1 is a longitudinal section through the lower portion of a vessel showing the slider valve;

FIG. 2 is a side elevational view, partly in section, of a bolt constructed in accordance with the invention and associated parts;

FIG. 3 is a top plan view of the bolt; and

FIG. 4 is a side elevational view of a portion of the bolt showing a modification.

FIG. 1 shows the longitudinal section of ladle 1 which is encompassed, from underneath, by mounting plate 2 of the slider valve. Slider housing 3 is connected to mounting plate 2 by articulated elements which are not shown on the drawing and which are located behind the plane of the section. The housing can be stopped in the position in which it is shown by locking elements which are not represented on the drawing. Sliding frame 4 is mounted in housing 3. The sliding frame can be shifted in the longitudinal direction and it is provided with a large number of openings which hold spring elements 5.

Ceramic head plate 6, provided with a orifice, is mounted in a recess of mounting plate 2, while sliding plate 7 which is, also, made of ceramic material, is mounted in a recess of sliding frame 4. The sliding plate is extended downwards by a collector nozzle which protrudes through slider housing 3 and through the shielding plates.

In the closed operating position, which is shown on the drawing, a large number of spring elements 5, which are provided in the front and in the rear portions of the sliding frame, are acting, by means of their heads, on the underside of sliding plate 7 and are pushing it upwards by spring action. The outer surface of head plate 6 rests upon the outer surface of sliding plate 7. In turn, head plate 6 is pressed against outer nozzle 8 of the ladle which fits tightly into a circular groove of headplate 8, provided with a sealing pack.

The slider housing and sliding frame 4 are provided with bushings which act as parts of a "bayonet" socket for the coupling with a positioning drive, which can comprise a hydraulic cylinder, which is not shown on the drawing. If sliding frame 4 is shifted inside of housing 3 by such a positioning drive it will carry along sliding plate 7 which will, move with respect to the fixed head plate. The force which presses the outer surface of head plate 6 against the outer surface of sliding plate 7 is generated by spring elements 5.

The longitudinal section of a spring element is shown in FIG. 2. The spring element is centered by bolt 9, head 10 of the latter is gripped, from underneath, by helical compression spring 11. The other end of the spring takes hold on washer 12 which is held on bolt 9 by circular key 13. Head 10 of bolt 9 is provided with a series of projections 14 which are square in the present example and are arranged in longitudinal and transverse rows which are easy to make: the conventional cylindrical head of a bolt is machined to provide perpendicular grooves so that the squares which form the remainder of the initial head surface constitute projections 14 arranged in perpendicular rows. FIG. 4 shows a modification in which the projections 14a are shaped as truncated pyramids when viewed from the side. Either design is further simplified, or made easier to make by using head 10 with a circular cross section (planar view) from which perpendicular segments have been removed by superimposing a square upon the circular cross section. This cross section and the arrangement of projections 14 are shown on the view of the outer surface of head 10 in FIG. 3. This figure shows clearly that the grooves which separate projections 14 are wider than the bases of the projections. As a result of this the surface of each spring element, which acts on the surface of sliding plate 7, is considerably reduced with respect to the total surface of head 10 of the bolt, so that the amount of heat transmitted by the sliding plate to the spring element and, consequently, also to compression spring 11 is considerably reduced and, therefore, the temperature is kept at a lower level. In addition heat can be removed by convection by the gasses or by the air which circulate in the grooves formed by projections 14. This cooling action can be considerably intensified by feeding compressed air.

By supporting sliding plate 7 by spring elements, provided with a large number of small projections 14, the thermal load of compression springs 11 of the spring elements is considerably reduced so that their lifetime is considerably increased. An additional advantage results from the fact that spring elements, provided with the projections 14, rest on the back side of sliding plate 7 practically without moving, so that, after mounting, the spring element with washer 12 is centered and supported in the corresponding recess of sliding plate 7 and guides the stem of bolt 9 while, at the same time, the head of the bolt is unrestrained in supporting sliding plate 7 by means of the projections.

The shape of the projections is subject to extensive changes; however, it was established that the sum of the top surfaces of the projections must be considerably smaller than the top surface of the head and that the grooves which separate the projections must penetrate relatively deeply into the head to provide the possibility for additional cooling. All these possible variations solve, by simple means the chosen problem of increasing the life time of the compression springs and of ensuring constant thrust exerted by the sliding plate upon the head plate.

I claim:

1. In a slider valve for a vessel, which valve comprises:

a replaceable fixed ceramic head plate;

a metal frame in which said head plate is mounted;

a replaceable ceramic slidable plate beneath said head plate;

a slidable frame in which said slidable plate is mounted;

operating means connected with said slidable frame; and a plurality of spring-loaded bolts carried by said frame and having heads;

the improvement in which the outer faces of the bolt heads carry a large number of projections which have crests located in a common plane transversely of the vessel;

said projections bearing against the underside of said slidable plate, whereby said bolts urge said slidable plate against said head plate.

2. A valve as defined in claim 1 in which said projections are square shaped when viewed from the side.

3. A valve as defined in claim 1 in which said projections have the shape of truncated pyramids when viewed from the side.

4. A valve as defined in claim 1 in which the base dimensions of said projections are smaller than the free spacings between projections.

5. A valve as defined in claim 1 in which said projections are arranged in rows.

6. A valve as defined in claim 1 in which the planar view of the bolt heads correspond with a circle from which segments have been removed by superimposing an intersecting square.

* * * * *